United States Patent [19]

Muriotto

[11] 4,255,915

[45] Mar. 17, 1981

[54] PROCESS FOR PRODUCING PREFABRICATED PANELS AND TRIDIMENSIONAL ELEMENTS FOR BUILDING AND PRODUCTS OBTAINED FROM SAID PROCESS

[76] Inventor: Angelo Muriotto, Via Antonio da Mestre 19, Mestre (Venezia), Italy

[21] Appl. No.: 26,063

[22] Filed: Apr. 2, 1979

[30] Foreign Application Priority Data

Apr. 18, 1978 [IT] Italy ..... 22413 A/78

[51] Int. Cl.[3] ..... E04B 5/04

[52] U.S. Cl. ..... 52/601; 52/309.16

[58] Field of Search ..... 52/601, 309.12, 309.16, 52/309.17, 280, 254

[56] References Cited

U.S. PATENT DOCUMENTS

| | | | |
|---|---|---|---|
| 2,144,630 | 1/1939 | Kotrbaty | 52/601 X |
| 2,184,146 | 12/1939 | Leguillon | 52/601 X |
| 2,718,829 | 9/1955 | Seymour et al. | 52/309:16 X |
| 3,327,442 | 6/1967 | Hermann | 52/309.16 |
| 3,484,999 | 12/1969 | Van Der Lely | 52/601 X |
| 3,679,529 | 7/1972 | Prusinski et al. | 52/309.12 X |
| 4,037,381 | 7/1977 | Charles | 52/601 X |
| 4,077,170 | 3/1978 | Van Der Lely | 52/601 |

FOREIGN PATENT DOCUMENTS

| | | | |
|---|---|---|---|
| 606868 | 7/1960 | Italy | 52/601 |
| 6803584 | 9/1969 | Netherlands | 52/601 |
| 1189992 | 4/1970 | United Kingdom | 52/601 |

*Primary Examiner*—J. Karl Bell

*Attorney, Agent, or Firm*—Michael J. Striker

[57] ABSTRACT

The invention is related to a process for producing prefabricated panels and tridimensional elements for building and the products obtained from said process. The panels produced are provided with a peripheral metallic frame (1), the sides of which are composed by shaped metallic sheet with an isosceles right-angled triangle cross section, the hypotenuse of which forms the outer face (4) of the panel, while the cathetus forms the inner face (2) of the frame having a width greater than the thickness of the main cement mixture layer (15) of the panel, the panels being assembled together along said inclined face and welded to form a tridimensional element.

16 Claims, 15 Drawing Figures

Fig. 13
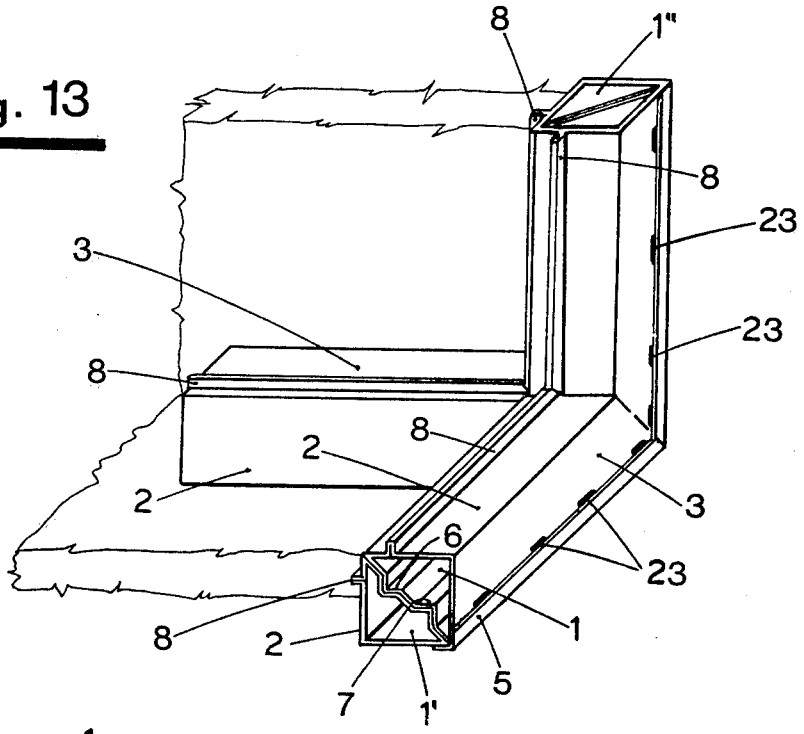
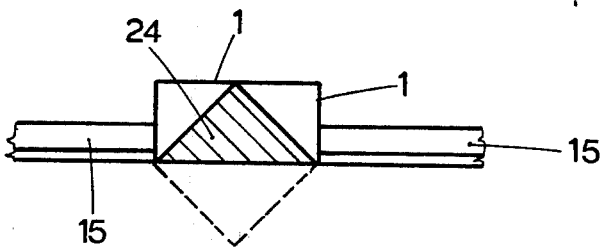
Fig. 14
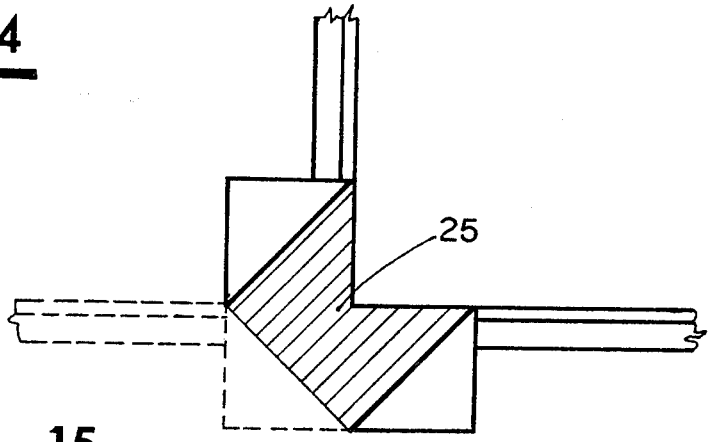
Fig. 15

PROCESS FOR PRODUCING PREFABRICATED PANELS AND TRIDIMENSIONAL ELEMENTS FOR BUILDING AND PRODUCTS OBTAINED FROM SAID PROCESS

This invention is related to a process for manufacturing in a factory prefabricated panels for building constructions and for producing prefabricated tridimensional elements, such as bathrooms and/or kitchens, or other tridimensional flat rooms.

The invention is also related to prefabricated panels and prefabricated tridimensional elements obtained from said process.

It is known art to produce light prefabricated panels provided with a peripheral metallic or plastic frame, but said panels can be employed only for particular uses. In this way, for example, some panels are employed only as walls or partitions and not as floors, because of their limited strength, while the panels employed as floors are not usable as walls or partitions.

Moreover panels are manufactured in a manner that they cannot include, already in the manufacturing process, a lining or a flooring of any kind, such as tiles and the like, which have to be necessarily applied after the completion of the panels, with a remarkable and expensive employ of labor.

Moreover, in the known panels, the peripheral frame was weak and conceived only for lining the thickness of the panel and consequently said frame had a width depending on the thickness of the panel and was not able to constitute a joint element adequately stout for connecting two adjacent panels, say at an angle of 90°.

French Pat. No. 1,095,395 discloses a prefabricated panel wherein a metallic peripheral frame is provided with a reinforcing rod armature and filled with beton or other materials, the thickness of the material being equal to the width of the metallic frame. Such a panel might be used only for constituting walls or partitions and needed fittings for the connection to similar panels.

French Pat. No. 1,020,534 discloses a prefabricated panel surrounded by frame elements and reinforced by a rod armature in the form of a net, the panel being formed with layers of beton and filling material. Such a panel might also be used only as a wall or a partition and needed fittings for the connection to similar panels.

French Pat. No. 2,192,631 discloses complicated and very expensive means for connecting the peripheral frames of prefabricated panels.

German patent application publication No. 2,004,998 discloses panel elements having a very heavy peripheral frame being unable to be connected to other panels at an angle of 90°.

Further U.S. Pat. No. 3,679,529 discloses a panel construction comprising a peripheral frame reinforced with a rod armature and a metallic net, said frame being filled with layers of resinous material and rigid foamed material and an outer layer formed by steel, aluminium or other materials.

Also such a panel needs supplementary fittings for the connection to similar panels.

An object of the present invention is the production of light and stout panels, employable to equal advantage as walls or partitions and as floors. The difference of the panels designed for constituting walls or floors consists only in the thickness of the filling material, without modifying the width of the periperal frame and without affecting the operations of the process for the production of the panel.

Another object of the invention is to provide a prefabricated panel having a stout peripheral frame, whose width is independent of the thickness of the panel and able to act as a stable junction between similar panels without requiring any supplementary fitting.

A further object of the invention is to provide a prefabricated panel allowing, in the manufacturing process, to incorporate a lining, constituted by a mixture, or a laminated material, or in the form of tiles.

A further object of the invention is to provide a prefabricated panel wherein the peripheral frame has a width greater than the thickness of the panel, so as to define, on the back of the panel, an empty space into which duct elements may be installed, such as hydraulic ducts, electrical ducts, heating ducts and the like.

A further object of the invention is to provide a very light and inexpensive finished prefabricated panel, designed to be easily mounted in the factory or in the yard, for composing tridimensional elements, such as bathrooms and/or kitchens, or any other flat room.

The process according to the invention is characterized by producing a square or rectangular frame, the sides of which are formed by a shaped metallic sheet, the cross section of each side having the form of an isosceles right-angled triangle, said sides being oriented so as a cathetus of the triangle constitutes the inner face of the frame, the other cathetus constitutes the back face of the frame and the hypotenuse constitutes the frame outer face inclined at 45°, with respect to the plane of the same frame, while the acute angle between the inner face and the outer face constitutes a peripheral border on the front of the frame; by reinforcing the frame by parallel metallic profiles, the ends of which are anchored to the opposed sides of the frame; by cutting one or more of said profiles for delimiting an aperture for a door or a window, said profiles having a flange about flush to the back face of the frame and the web protruding to a determined level into the space delimited by the frame; by laying a reinforcing metallic net immediately under the webs of said parallel profiles; by disposing the frame so reinforced on a resting plane, resting it with the acute angle peripheral border, and by pouring a cement mixture into the frame to form a main layer, the thickness of which, measured from said resting plane, is sufficient to merge said metallic reinforced net and the lower portion of the webs of the reinforcing profiles.

In the case wherein the panel is designed to have a lining on the front face, said lining is laid off on the resting plane within the periphery of the frame and over said lining is poured the cement mixture, to form the first layer.

In the case wherein the lining is formed by tiles or the like; on the resting plane is superimposed a support plane having plan sizes corresponding to the inner sizes of the frame and provided with arranged seats according to the arrangement of the tiles and the like, and wherein said tiles are located with the front face oriented toward the bottom of the respective seat, on said support plane is then applied the frame and into the frame is poured the cement mixture to form the first layer incorporating the back face of the tiles.

In a preferred embodiment of the invention, a cement mixture is used which is non-flammable, washable, colloidal, elastic, waterproof and water-repellent.

Such a cement mixture may be obtained with the following composition:

crusher sand
finely riddled gravel
white cement
water
cellulose-derivative
styrol-acrylic copolymer in aqueous dispersion at 90%.

The percentage of the above compositions may vary within acceptable ranges, depending on the use of the panel and the availability of the materials.

An embodiment of the invention is disclosed in the accompanying drawings wherein.

FIG. 5 is a partial section view of a panel provided with a lining of tiles or the like;

FIG. 13 is a perspective view showing a tridimensional coupling of three adjacent panels;

FIGS. 14 and 15 are cross section views of different embodiments of pillars allowing the junction between adjacent panels.

Figure 1:
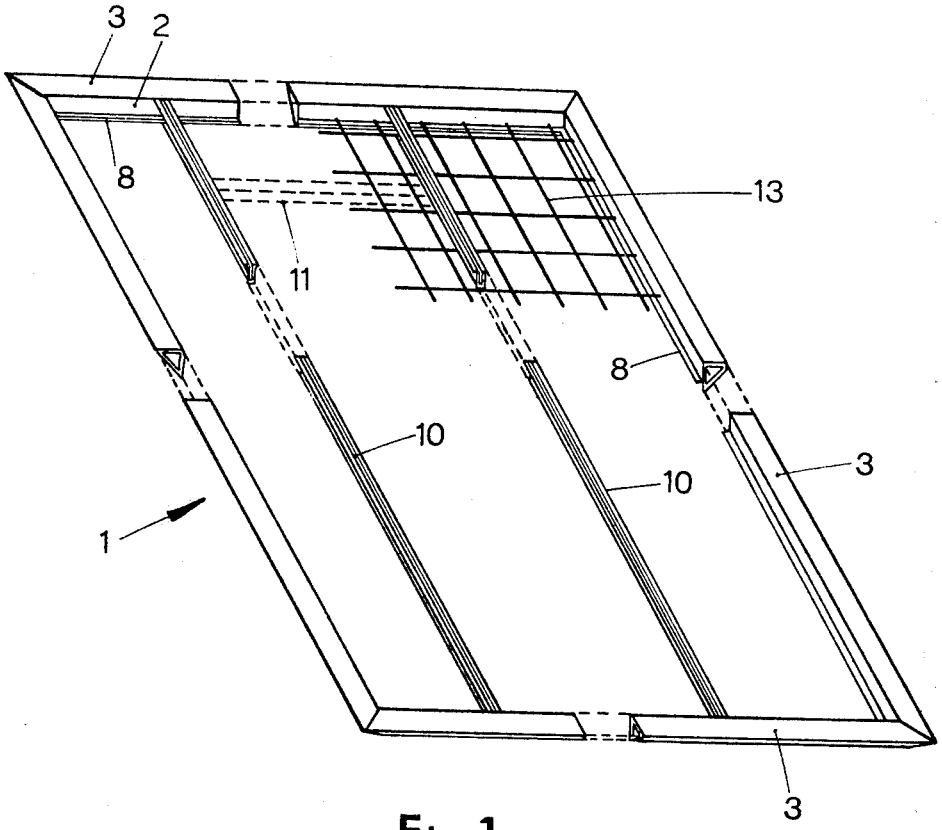
FIG. 1 is a perspective view of the frame designed to encircle the panel to be produced.
Figure 2:
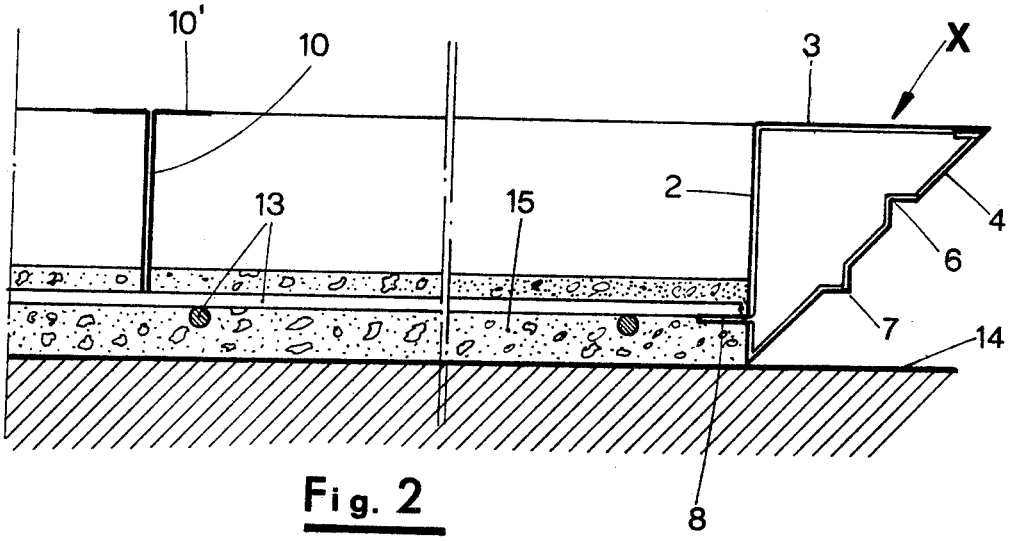
FIG. 2 is a partial section view of the panel showing the main cement mixture layer and a section view of the profile forming the peripheral frame.

According to the present invention, a peripheral frame 1 is composed, as shown in FIGS. 1 and 2, to produce prefabricated panels.

The sides of said peripheral frame are obtained by a metallic sheet, such as steel sheet or ribbon or two parallel ribbons, by rolling them to obtain a profile having an isosceles right-angled triangle cross section.

Figure 5:
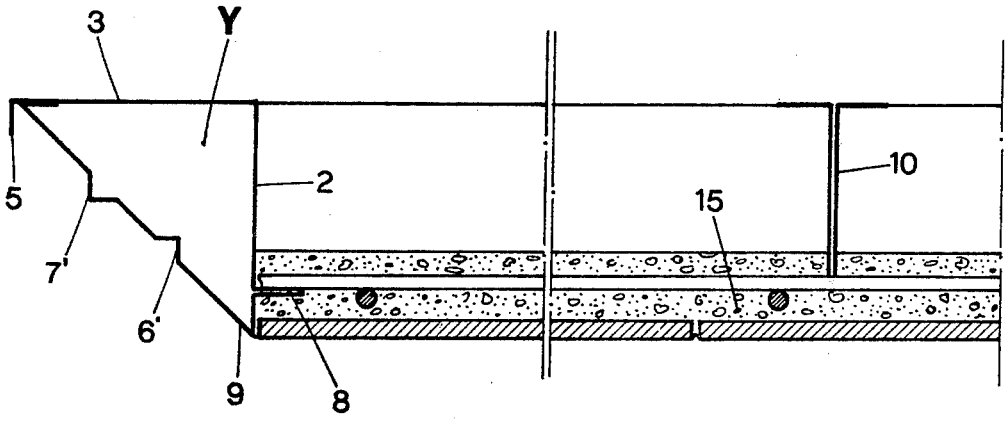
Figure 6:
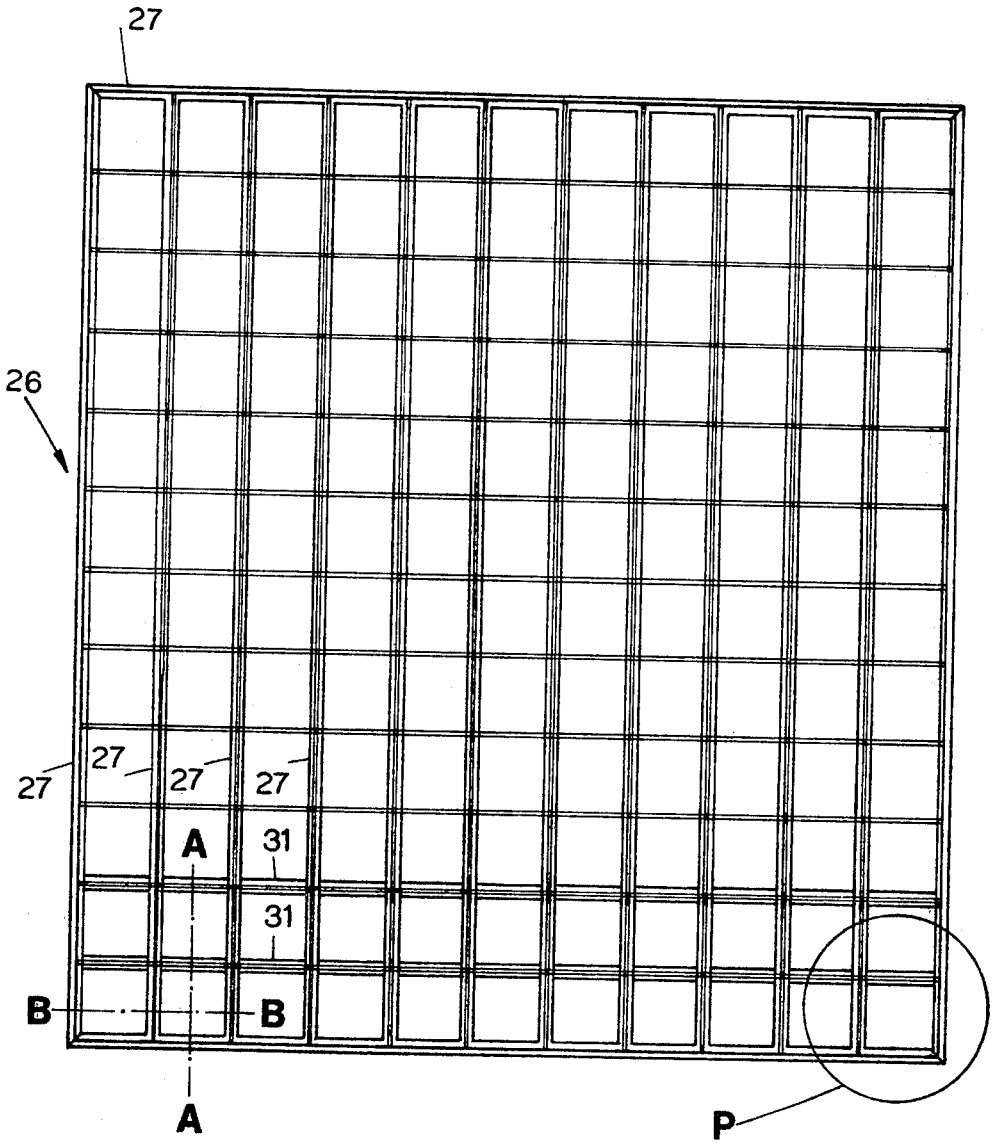
FIG. 6 is a plan view of a support plane for the tiles to be attached to the panel.

To compose the peripheral frame, said profile, as best shown in FIGS. 2 and 5, is oriented so that a cathetus constitutes the inner face 2 of the frame, the other cathetus constitutes the back face 3 of the frame, and the hypotenuse 4 constitutes the external face of the frame, inclined at 45° with respect to the plane of the same frame.

The cross section sizes of each profile are provided wide enough, so that the width of the inner face 2 of the frame is much greater than the thickness of the main layer of the cement mixture forming the finished panel, as is apparent in FIG. 2.

The hypotenuse face 4 is normally flat, but in some cases it may be provided with longitudinal shapings, for example a groove 6 and a rib 7.

Due to the fact that the inclined face 4 is designed to match with the inclined face of another adjacent frame, and the adjacent profiles have to be fixedly connected therebetween, the matching is possible only slightly modifying the shape of the same profiles. The profile of FIG. 2, indicated with X, shows in fact the groove 6 and the rib 7 in a determined position; while the profile of FIG. 5, indicated with Y, shows the groove 6' and the rib 7' in inverted positions. In this manner, in matching juxtaposed profiles, i.e. in the position shown in FIG. 12, the groove 6 accommodates the rib 7' and the groove 6' accommodates the rib 7. Moreover, the profile Y shows an edge 5, bent at a right angle with respect to the face 3, so as, in the matching of FIG. 12, said edge 5 is superimposed to the face 3 of the profile X, where it is fixed by welding points, for example as shown in FIG. 13.

The inner face 2 of each profile shows a flat continuous projection 8, at a short distance from the lower edge 9, corresponding to an acute angle corner of the profile. The flat continuous projection 8 may be obtained by bending outwardly two juxtaposed longitudinal edges of two parallel metallic ribbons shaped for composing the profile, or it may be obtained, in an integral piece, in the case where the profile is obtained by shaping a sole metallic ribbon.

The frame 1, composed as in FIG. 1, is reinforced by iron parallel profiles 10, preferably of T-cross section, disposed so that their flange 10' is flush to the face 3, while their web is shortly spaced above the plane generated by the flat continuous projections 8. The frame 1 is further reinforced by a metallic net 13 extending through all the clearance of the frame and having its edges secured to the projections 8, for example by welding.

The arrangement of the reinforcing profiles 10 provides for openings in the panel, such as a door, or a window, when required. In the case, as shown in FIG. 1, an opening for a door is provided connecting two adjacent profiles 10 with a transverse profile 11; in case that the profiles 10 are more approached, the opening is obtained interrupting one or more profiles 10, otherwise comprised into the clearance of the opening and connecting the adjacent uninterrupted profiles with transverse profiles 11.

The frame so composed is disposed on a resting plane 14, with the corner 9 of the face 2 contacting the same resting plane. In such a way the resting plane and the frame generate a form into which a cement mixture may be poured.

The cement mixture is then poured in an amount to form a main layer 15 having a thickness such to incorporate the metallic net 13 and a portion of the web of the profiles 10, obtaining in any way a thickness limited with respect to the width of the inner face 2.

In case that the panels are designed to form walls or partitions, the thickness may be about 3 cm, alternatively in case the panels are designed to form floors, said thickness may be widened to about 6 cm. Said thickness sizes are preferred, but not limitative, of the invention.

The thickness variation, in any way, requires no variation of both the process and the component elements of the panel.

The main layer of cement mixture is allowed to set and then the panel is raised in a vertical position and left to ripen.

As already discussed, there is preferred a cement mixture meeting determined technical requirements, i.e. it is non-flammable, elastic, washable, colloidal, waterproof and water-repellent.

A preferred composition of the invention is the following:

| | | |
|---|---|---|
| crusher sand | Kg. | 700 |
| finely riddled gravel (3 to 10 mm) | " | 700 |
| white cement (untacky) | " | 1,000 |
| cellulose-derivative | " | 20 |
| styrol-acrylic copolymer in aqueous dispersion at 90% | lt. | 50 |
| water | " | 500 |

The percentages of the components may be varied according to the material availability and the use of the panel. Moreover one or any of the components may be omitted, except the white cement and the water.

The resting plane 14 is used for obtaining the front face of the panel, said front face resulting sufficiently flat and smooth, when the panel must not have any lining over said front face.

When the front face of the panel must be constituted by a lining, and in case said lining has to be obtained from a mixture, said mixture may be laid on the same resting plane forming a layer around which is then disposed the frame to pour the cement mixture forming the main layer.

In the same manner, when the lining is constituted by a sheet, such as a plastic, metallic or wood laminate sheet, the latter is disposed on the resting plane 14 and therearound there is disposed the frame 1.

Figure 3:
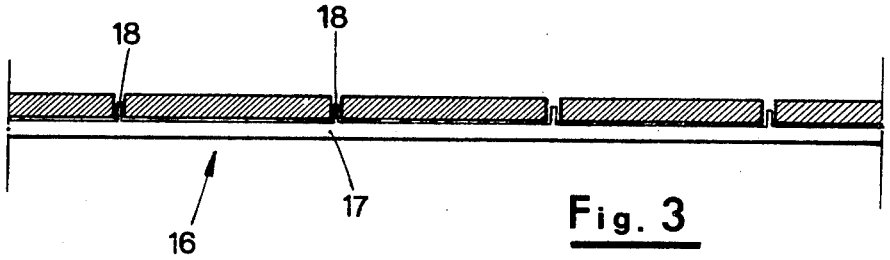
FIG. 3 is a section view of a support plane for the arrangement of tiles or the like, forming a flooring or a lining attached to the frontal face of the main cement mixture layer.
Figure 4:
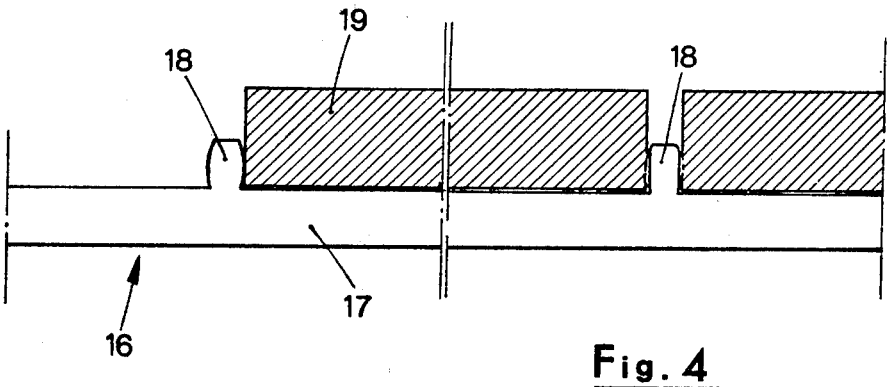
FIG. 4 is a view of a detailed portion, in enlarged scale, of FIG. 3.

When the lining is constituted by tiles and the like, such as ceramic tiles, it is preferred to use a support plane 16, shown in FIGS. 3 and 4 or the support shown in FIGS. 6 to 9.

The support 16, shown in FIGS. 3 and 4, is composed by a mat 17 of adequate thickness and having plan sizes about similar to the inner sizes of the frame 1. Said mat is provided on the exposed face with two series of rectilinear ribs 18, intercepting each other at a right angle, forming in this way square or rectangular seats having plan sizes corresponding to the plan sizes of the tiles to be incorporated. Said seats, however, may have a different form, according to the particular form of the employed tiles.

Each seat accommodates a respective tile and the ribs 18 are thin enough to establish the gap between a tile and the adjacent tiles.

The use of said support 16 is necessary to prevent the tiles from displacing out of register during the pouring of the cement mixture and to establish an univocal tile position compensating for the defects of the tiles, such as different baking shrinkages, imperfect squareness at the corners or other defects.

Said support 16, moreover, may be produced of any suitable material. A preferred material is a silicon resin. Said silicon resin, in effect, does not adhere to the cement mixture and is resilient, so that it detaches easily during the delivery step, while the ribs 18 detach easily from the gaps between the tiles owing to their resiliency.

Moreover, the silicon resin shows an high mechanical strength, it is unalterable over long periods of time and is resistant up to a temperature of 300° C., so that it shows a long life and provides the possibility to treat the panels in steam ovens.

As shown in FIG. 4, the ribs 18 have a height less than the thickness of the tiles 19 and have a lightly convex cross section facilitating a resilient yielding of the same rib, so as to allow the forced insertion, without play, of the tiles, to limit the adherence of the tiles and to assist the delivery of the panel.

The support 16 is rested on the resting plane 14, the tiles 19 are disposed into the seats of the support 16 with their front face facing toward the bottom of the same seats, and around the support 16 is positioned the frame 1. The cement mixture is then poured, as processed with respect to FIGS. 1 and 2, so that the adherence of the tiles to the cement mixture is obtained.

As a consequence, a prefabricated panel is produced already completed with an exposed lining, so that no further operation is required.

According to another embodiment, in place of the support 16, the support of FIGS. 6 to 9 may be employed. This support is particularly employable when a perfect resting plane is not available. Said support, moreover, apart from its own stiffness, does not show any inconvenience of adherence due to a sucker effect, it is mechanically stronger and is obtained at a cost less than the support in silicon resin.

The support 26 is formed by a square or rectangular peripheral frame 27, depending from the plane form of the panel to be produced, said frame being obtained by profiles 28, preferably in extruded aluminium, having a square or rectangular hollow cross section and being integral with a projecting T-section profile 29 on the upper face, with the flange of the T resting on the same upper face 30 and integral with the latter, so that the web is projected upwardly.

The same profiles 27 are employed to form a range of equispaced parallel bars, and having the ends anchored to the opposed sides of the frame, the distance (FIG. 6) being foreseen so that, between the webs of two profiles 29 of two adjacent profiles 27, a size of a tile is exactly comprised.

Figure 8:
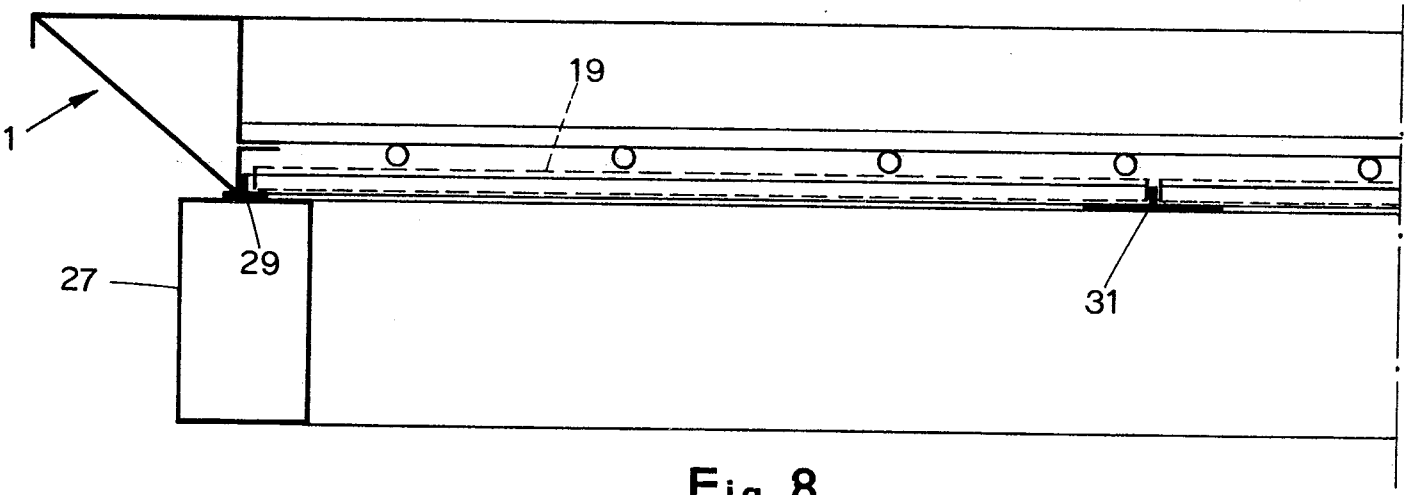
FIG. 8 is a section view in enlarged scale of the cross section A—A of FIG. 1.

The profiles 27 are connected together by transverse profiles 31, also preferably obtained from extruded aluminium, and having a T-cross section with a very large flange and the web having the same height as the web of the profiles 29 (FIG. 8).

Figure 7:
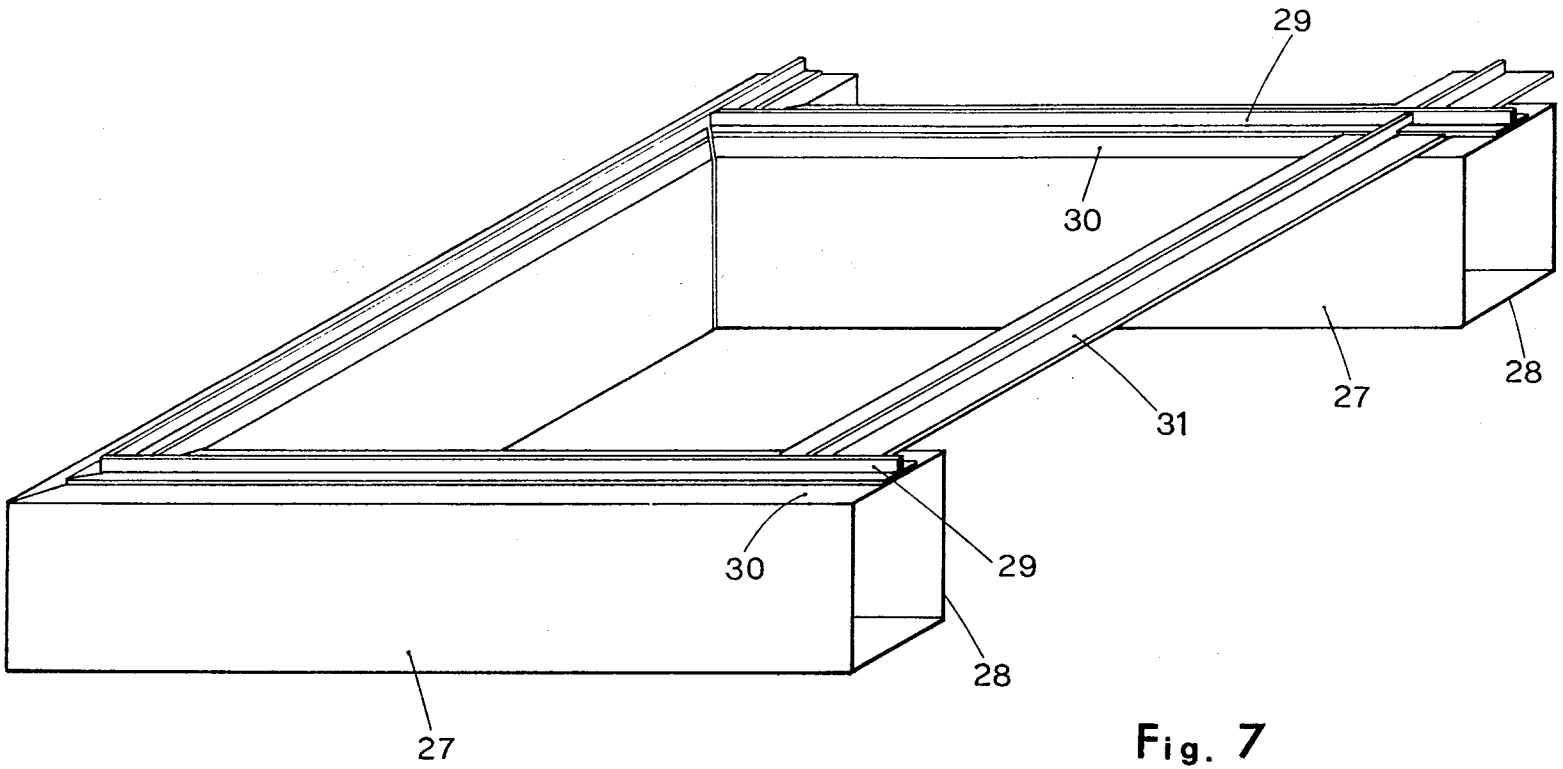
FIG. 7 is a view in enlarged scale of the detail "P" of FIG. 6.

In FIG. 7 there is shown the manner whereby the profiles 31 are disposed with respect to the profiles 29.

Figure 9:
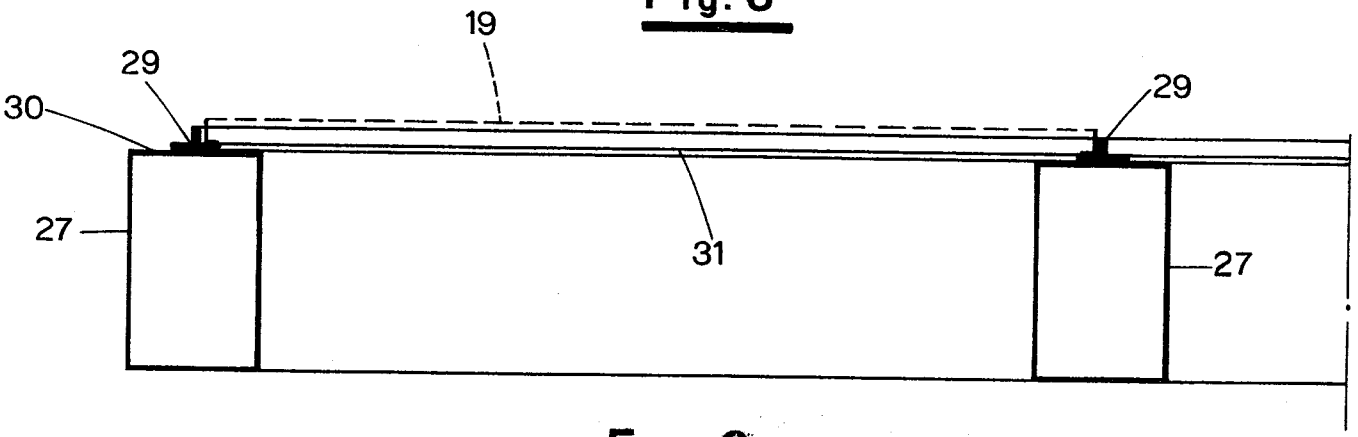
FIG. 9 is a view in enlarged scale of section B—B of FIG. 6.

It has to be noted from FIG. 7, as well as from FIGS. 8 and 9, that the flanges of the profiles 29 and 31 constitute the resting edges for a tile 19, shown in phantom lines in FIGS. 8 and 9, with the thickness of the same tile higher than the height of the webs of the profiles 29 and 31.

The resulting support is remarkably stiff, above all for the stiffness of the profiles 27, so that said support may be rested everywhere, also on casual resting elements, while the setting of the tiles takes place very easily.

As shown in FIGS. 8 and 9, once positioned the tiles, there is rested, around the peripheral frame, the frame 1 of the panel to be produced already provided with reinforcing elements such as the armature of the profiles 10 and the metallic net 13.

Figure 10:
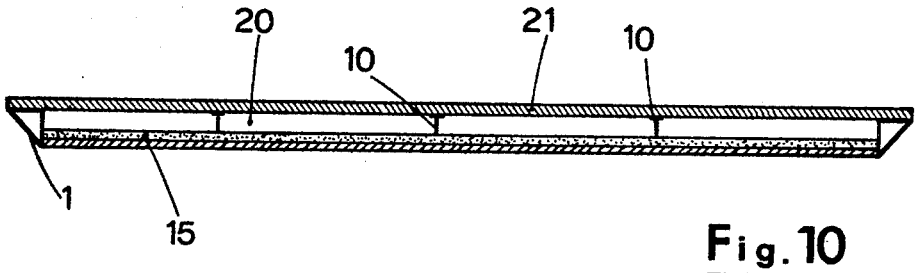
FIG. 10 is a cross section view of a finished panel according to a first embodiment.

As shown in FIG. 10, the produced panel, provided or not with a front lining, is structured by a peripheral frame 1, the inner face of which is higher than the thickness of the main cement mixture layer, so that on the back of said layer, the frame 1 delimits an empty space 20.

Said space 20 may be utilized for containing the installations of different services, such as water, electrical heating, heating and discharging outlets. Moreover the empty space 20 may be closed by a plate 21, for example of plaster, asbestos cement, plastic or the like, fixed to the peripheral frame 1 and resting on the webs of the reinforcing profiles 10.

Figure 11:
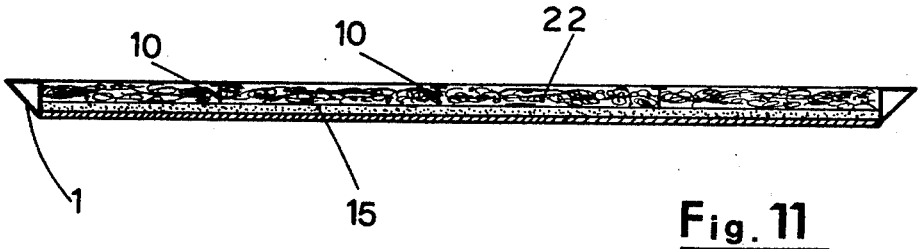
FIG. 11 is a cross section view of a finished panel according to a different embodiment.

The same empty space 20 (FIG. 11) may be filled with insulating materials, such as mineral wools, foamed resins or other insulating materials, depending on the degree of the predetermined heat insulation or sound proofing.

Alternatively the empty space 20 may be filled with a layer 22 of light material, such as expanded cement, expanded clay, laid after the main layer 15.

The panels obtained according to FIGS. 1 to 11 are easily connectable together to compose tridimensional elements.

Figure 12:
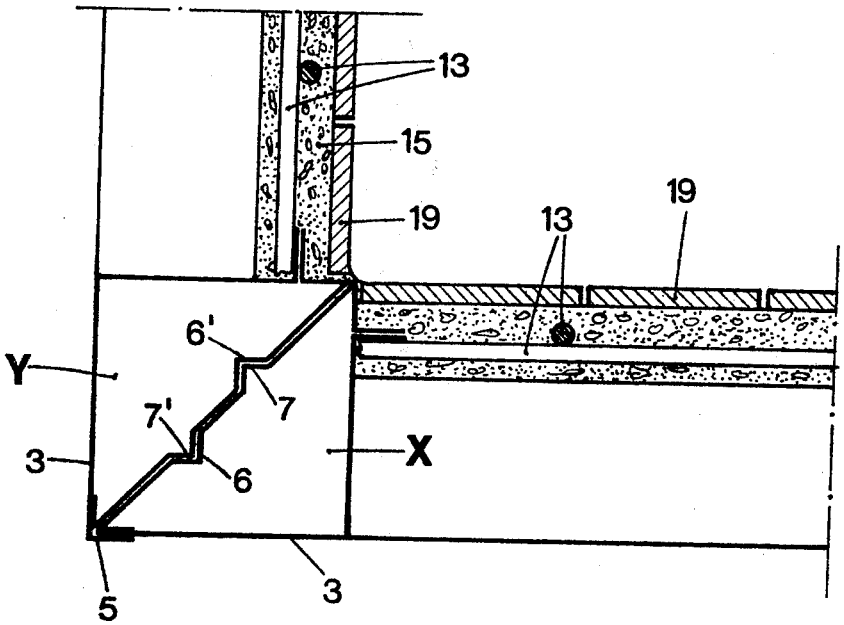
FIG. 12 is a cross section view of a right-angled corner formed by two adjacent panels.

FIG. 12 shows a right-angle connection executed using two adjacent panels.

It may be seen how the profile X of a panel frame side is faced along the hypotenuse with the profile Y of a frame side of the adjacent panel. When grooves 6, 6' and ribs 7, 7' are used, the facing between the groove 6 and the rib 7' and between the groove 6' and the rib 7 allows to register the two profiles taking care to superimpose the bent edge 5 of the profile Y over the face 3 of the profile X, to the end to execute the necessary weldings. In connecting two adjacent panels, the front faces of the same panels are disposed inwardly of the formed right angle.

The facing sides may be joined sturdily by welding and, as above discussed, the junction may be completed by overlaying the bent edge 5 and disposing welding points 23, as shown in FIG. 13.

The connection, however, may be embodied using other connecting means, such as bolts, nails, rivets or gluing.

FIG. 13 shows a tridimensional connection using three panels to obtain a floor and two adjacent walls. It has to be noted how the frame of a vertical panel is combinable, along the horizontal side, with the frame 1' of an horizontal panel, designed to form a floor, and along a a vertical side with a second frame 1'' of another vertical panel.

Whatever might be the connecting means employed for connecting the profile of different frames, said connection is accomplished easily and quickly, requiring a minimum employ of labour and requiring no additional members or fittings.

The connection, moreover, is accomplished along wide facing areas, so that the structure obtained is stiff and steady.

The composition of tridimensional elements, moreover, may be executed indifferently in the factory or in the yard, the preference depending, above all, from the sizes of the rooms to be produced.

In this way, for example, bathrooms and/or kitchens, the sizes of which may be contained into the ecumbrances allowed by the traffic regulations, are preferably assembled in the factory, while rooms, having sizes not allowed by the traffic regulations, have to be assembled in the yard.

In assembling the panels in the yard, the necessity may arise to connect the panels to the pillars of the carrying structure of the building. In these cases the present invention provides for sections and dispositions of pillars able to allow the connections of the frames 1 of the panels.

FIG. 14 shows an upright or pillar 24 having an isosceles right-angled triangle cross section having the cathetus sized like the hypotenuse of the profiles of the frames 1. In this way two frames 1 may be anchored, as in FIG. 14, to form a continuous planar wall composed by two successive panels.

The pillar 24 may be replaced by a square cross section pillar, as indicated by the completion shown in phantom lines in the same FIG. 14.

FIG. 15 shows a different upright or pillar 25, the cross section of which comprises the $\frac{3}{4}$ of a square, particularly able to connect at right angles two or three panels, when the latter have to be necessarily anchored to a pillar.

Evidently uprights or pillars having different cross sections may be provided for connecting two or more panels at a right angle or in a plane, said uprights or pillars may be produced in metal (steel) or reinforced concrete on condition that they are provided with connecting means for the frames 1.

I claim:

1. A process for producing prefabricated panels of the kind having a peripheral metallic frame (1), reinforced with a metallic structure (10) and/or a metallic net (13), said panel having at least a layer (15) of cement mixture or other material, characterized by producing a square or rectangular frame (1), the sides of which are formed by shaped metallic sheet, the cross section of each side having the form of an isosceles right-angled triangle, said sides being oriented so that a cathetus of the triangle constitutes the inner face (2) of the frame, the other cathetus constitutes the back face (3) of the frame and the hypotenuse constitutes the frame outer face (4) inclined at 45° with respect to the plane of the same frame, while the acute angle between the face (2) and the outer fare (4) constitutes a peripheral border (9) on the front of the frame; by reinforcing the frame by parallel metallic profiles (10), the ends of which are anchored to the opposed sides of the frame (1); by cutting one or more of said profiles for delimiting an aperture for a door or a window, said profiles (10) having a flange about flush to the back face (3) of the frame and the web protruding to a determined level into the space delimited by the frame; by laying a reinforcing metallic net (13) immediately under the webs of said parallel profiles (10); by disposing the frame so reinforced on a resting plane, resting it with the acute angle peripheral border (9), and by pouring a cement mixture into the frame to form a main layer (15), the thickness of which, measured from said resting plane, is sufficient to merge said metallic reinforced net and the lower portion of the webs of the reinforcing profiles (10).

2. A process as claimed in claim 1, wherein the isosceles right-angled triangle cross section profiles are produced by shaping metallic ribbon or ribbons.

3. A process as claimed in claim 1, wherein on the shaping of the profiles having an isosceles right-angled triangle cross section, a flat continuous projection (8) is produced on the inner face (2) of the frame at the same level of the reinforced net (13), so as the edges of said net are anchored on said flat continuous projection.

4. A process as claimed in claim 1, wherein for the production of panels having a lining on the front face, said lining is laid on the resting plane (14) and around said lining is disposed the reinforced frame so that the pouring of the cement mixture is carried out over said lining.

5. A process as claimed in claim 1, wherein panels are produced lined with tiles, the tiles being arranged on a support plane (16) provided with ranged seats into which the tiles are disposed and registered with their front face directed toward the bottom of the seats, said support plane being disposed on the horizontal resting plane and therearound the reinforced frame is disposed, so as the main cement mixture layer is laid into the frame and over the back faces of the tiles, causing the adherence of the tiles to the main cement mixture layer.

6. A process as claimed in claim 5, wherein the support plane for the tiles is formed by a mat (17) of resilient material, such as silicon resin, provided with two series of parallel ribs (18) crossing together to form square or rectangular seats for accomodating the tiles, said ribs being of convex cross section.

7. A process as claimed in claim 5, wherein the support plane is constituted by a rigid structure (26) formed by profiles, preferably of extruded aluminium, a first series of said profiles forming the peripheral frame and a series of parallel bars being constituted by hollow profiles (27) having square or rectangular cross section, provided on the upper face with T-cross section profiles (29) having their flange resting on said upper face and the web directed upwardly from said upper face, and a second series of profiles (31) having a T-cross section, being disposed perpendicularly to the first series, and anchored to the T-cross section profiles (29) of the first series, to form a grating generating square or rectangular seats for accommodating respective tiles.

8. A process as claimed in claim 1, wherein the cement mixture, used for composing the main layer of the panel, has the following composition:

crusher sand
finely riddled gravel (3 to 10 mm)
white cement (untacky)
cellulose-derivative
styrol-acrylic copolymer in acqueous dispersion at 90%
water the percentage being variable into technically acceptable limits and with the possibility to eliminate at least one of the components.

9. A process as claimed in claim 1, consisting in covering the empty space (20) on the back of the panel by means of a covering plate (21).

10. A process as claimed in claim 1, wherein the empty space 20 is filled with light or insulating material (22).

11. A process for forming tridimensional elements characterized by connecting at right angles the panels produced in claim 1, facing the adjacent panels along the outer inclined faces (4), the panels being oriented so as the front faces of the same are oriented inside the right angle formed and by fixing the juxtaposed sides of the respective frames using any connecting means, preferably by welding.

12. A process as claimed in claim 11, wherein the sides of the respective panels facing each other along the outer inclined face are connected together by bending a continuous edge (5) of one profile over the juxtaposed profile and connecting it by welding.

13. A prefabricated panel for building characterized by a rectangular or square peripheral frame (1), the sides of which are of shaped sheet and have an isosceles right-angled triangle cross section, oriented so as one of the cathetus constitutes the inner face (2) of the frame, the other cathetus constitutes the back face (3) of the frame and the hypotenuse constitutes the outer face (4) inclined at 45° with respect to the plane of the frame, while on the front face the frame is delimited by a peripheral corner (9), corresponding to the acute angle adjacent to the cathetus forming the inner face, the width of the frame being determined by the cathetus forming the inner face (2), by a reinforcing armature reinforcing said frame constituted by parallel profiles 10, the ends of which are anchored on two opposed sides of the frame and having a flange (10') flush to the common plane (3) of the frame, by a reinforcing metallic net disposed under said profiles (10), by a main cement mixture layer (15), the thickness of which, measured from said acute angle corner (9) is sufficient to incorporate said metallic net and a portion of the webs of the profiles (10), so as on the back of the panel an empty space (21) is delimited.

14. A prefabricated panel as claimed in claim 13, characterized in that it is provided on the front face with a lining, constituted by a mixture layer, a laminated material or tiles and the like, incorporated in the cement mixture of the main layer (15).

15. A prefabricated panel as claimed in claim 13, characterized in that on the inner face of the frame is provided a flat continuous projection (8) constituting a means for resting and anchoring the peripheral edges of the metallic net.

16. A prefabricated panel as claimed in claim 13, characterized in that the cement mixture layer incorporating the metallic net is non-flammable, colloidal, resilient, waterproof and water-repellent.

* * * * *